US010421116B2

(12) United States Patent
Qiao et al.

(10) Patent No.: US 10,421,116 B2
(45) Date of Patent: Sep. 24, 2019

(54) METHOD OF CASTING VALVE SEAT INSERTS AND CASTING APPARATUS

(71) Applicant: L.E. Jones Company, Menominee, MI (US)

(72) Inventors: Cong Yue Qiao, Menominee, MI (US); David M Doll, Houston, TX (US); Donald K Morris, Peshtigo, WI (US); Howard Delorme, Jr., Menominee, MI (US)

(73) Assignee: L.E. Jones Company, Menominee, MI (US)

( * ) Notice: Subject to any disclaimer, the term of this patent is extended or adjusted under 35 U.S.C. 154(b) by 117 days.

(21) Appl. No.: 15/641,646

(22) Filed: Jul. 5, 2017

(65) Prior Publication Data

US 2019/0009327 A1 Jan. 10, 2019

(51) Int. Cl.
*B22C 9/02* (2006.01)
*B22C 9/20* (2006.01)
(Continued)

(52) U.S. Cl.
CPC ..... *B22C 9/02* (2013.01); *B22C 9/20* (2013.01); *B22C 9/22* (2013.01); *F01L 3/22* (2013.01);
(Continued)

(58) Field of Classification Search
CPC ..... B22C 9/08; B22C 9/082; B22C 9/088; B22C 9/20; B22C 9/22; B22D 25/02; B22D 25/06; B22D 25/08; B22D 27/04
See application file for complete search history.

(56) References Cited

U.S. PATENT DOCUMENTS 1,359,196 A 11/1920 Rau
2,807,845 A * 10/1957 Sawyer ..... B22C 23/00 164/37
(Continued)

FOREIGN PATENT DOCUMENTS

CA 1182272 A 2/1985
JP S59127949 A 7/1984
(Continued)

*Primary Examiner* — Kevin E Yoon
*Assistant Examiner* — Jacky Yuen
(74) *Attorney, Agent, or Firm* — Buchanan Ingersoll & Rooney PC

(57) ABSTRACT

A method of casting valve seat inserts comprises pouring molten metal into a gating system of a mold plate stack wherein mold plates are located between top and bottom molds wherein the gating system includes a casting header, down-sprue, horizontal sprue, up-sprues, runners, and gates in fluid communication with mold cavities configured to form the valve seat inserts. The method includes filling the mold cavities with the molten metal, and controlling solidification of the molten metal in the mold cavities by means of an outer thermal barrier which retards heat transfer in mold plate material between the mold cavities and an outer periphery of the mold plate stack. An inner thermal barrier can be used to further control solidification of the molten metal. Valve seat inserts produced using the thermal jacket molds can exhibit an improved microhardness distribution which provides improved machining and higher yield.

15 Claims, 5 Drawing Sheets

(51) Int. Cl.

| | |
|---|---|
| ***B22C 9/22*** | (2006.01) |
| ***F01L 3/22*** | (2006.01) |
| *F02F 1/24* | (2006.01) |
| *B22C 9/10* | (2006.01) |
| *B22C 13/08* | (2006.01) |
| *F01L 3/02* | (2006.01) |

(52) U.S. Cl.
CPC ..... *B22C 9/101* (2013.01); *B22C 13/08* (2013.01); *F01L 3/02* (2013.01); *F01L 2101/00* (2013.01); *F01L 2103/01* (2013.01); *F02F 1/24* (2013.01)

(56) References Cited

U.S. PATENT DOCUMENTS

| | | | |
|---|---|---|---|
| 4,112,997 | A | 9/1978 | Chandley |
| 4,133,371 | A | 1/1979 | Birch et al. |
| 4,241,492 | A | 12/1980 | Hedberg |
| 4,246,954 | A | 1/1981 | Cohen et al. |
| 4,367,782 | A | 1/1983 | Schrader |
| 4,981,167 | A | 1/1991 | Anderson |
| 5,135,041 | A | 8/1992 | Goss |
| 5,735,334 | A | 4/1998 | Sutton et al. |
| 6,460,603 | B1 | 10/2002 | Damm et al. |
| 2008/0001115 | A1 | 1/2008 | Qiao et al. |
| 2009/0257906 | A1 | 10/2009 | Qiao et al. |
| 2016/0245132 | A1 | 8/2016 | Qiao et al. |

FOREIGN PATENT DOCUMENTS

| | | | |
|---|---|---|---|
| JP | S59220248 | A | 12/1984 |
| JP | S61193765 | A | 8/1986 |
| JP | H09225584 | A | 9/1997 |
| JP | 2011189403 | A | 9/2011 |

* cited by examiner

METHOD OF CASTING VALVE SEAT INSERTS AND CASTING APPARATUS

FIELD OF THE INVENTION

The present disclosure relates to a method of casting corrosion and wear-resistant alloys with high hardenability that may be used, for example, in valve seat inserts.

BACKGROUND INFORMATION

In conventional casting systems, liquid metal is directed through a vertical sprue, horizontal distribution sprue, runner, and gate into a casting cavity. In manufacturing valve seat inserts (VSIs), such a system can be used with sand molds. In some VSI casting processes, shrinkage and hot tear susceptibility can be a problem even with riser type gating systems.

There is a need for improved VSI casting systems which minimize shrinkage and hot tear susceptibility of the cast VSIs.

SUMMARY

In an embodiment, a method of casting valve seat inserts comprises pouring molten metal into a gating system of a mold plate stack wherein mold plates are located between top and bottom molds, the gating system including a casting header, down-sprue, horizontal distribution sprue, up-sprues, runners, and gates in fluid communication with mold cavities configured to form the valve seat inserts, filling the mold cavities with the molten metal, and controlling solidification of the molten metal in the mold cavities by means of an outer thermal barrier which retards heat transfer in mold plate material between the mold cavities and an outer periphery of the mold plate stack.

In a further embodiment, solidification of the molten metal in the mold cavities is further controlled by means of an inner thermal barrier which retards heat transfer in the mold plate material between the mold cavities and the down-sprue. The outer thermal barrier can be a channel extending into a surface of each mold plate and the inner thermal barrier can be a channel extending into a surface of each mold plate. For example, the outer and inner thermal barriers can be air gaps.

In one embodiment, each of the mold plates is a circular sand mold plate having a central opening corresponding to the down-sprue extending vertically between upper and lower surfaces of the mold plate, at least two circumferentially spaced openings corresponding to the up-sprues extending vertically between the upper and lower surfaces of the mold plate, at least two ring-shaped mold cavities extending into the upper surface of the mold plate, at least two circular recesses extending into the upper surface of the mold plate at locations such that each ring-shaped mold cavity surrounds one of the circular recesses, at least two runners arranged such that at least one of the runners extends from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

In another embodiment, each of the mold plates is a circular sand mold plate having a central opening corresponding to the down-sprue extending vertically between upper and lower surfaces of the mold plate, at least four circumferentially spaced openings corresponding to the up-sprues extending vertically between the upper and lower surfaces of the mold plate, at least eight ring-shaped mold cavities extending into the upper surface of the mold plate, at least eight circular recesses extending into the upper surface of the mold plate at locations such that each ring-shaped mold cavity surrounds one of the circular recesses, at least eight runners arranged such that at least two of the runners extend from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

In a further embodiment, each of the mold plates is a circular sand mold plate having a central opening corresponding to the down-sprue extending vertically between upper and lower surfaces of the mold plate, at least six circumferentially spaced openings corresponding to the up-sprues extending vertically between the upper and lower surfaces of the mold plate, at least eighteen ring-shaped mold cavities extending into the upper surface of the mold plate, at least eighteen circular recesses extending into the upper surface of the mold plate at locations such that each ring-shaped mold cavity surrounds one of the circular recesses, at least eighteen runners/gates arranged such that at least three of the runners/gates extend from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

In a method wherein the molten metal is a wear and corrosion resistant alloy, nickel-base alloy, or cobalt-base alloy, the method can further comprise maintaining a uniform temperature distribution of the molten metal during solidification of the valve seat insert castings.

In a method wherein the top mold incudes an annular recess in an upper surface thereof with the annular recess in fluid communication with the up-sprues, the method can include filling the mold cavities with molten metal until the annular recess contains overflow of the molten metal and provides a visual indication of when the molten metal has filled all of the mold cavities.

In a further embodiment, an apparatus for casting valve seat inserts comprises a mold plate stack comprising mold plates located between top and bottom molds, and a gating system including a casting header, down-sprue, horizontal distribution sprue, up-sprues, and runners/gates in fluid communication with mold cavities configured to form the valve seat inserts, the mold cavities located in upper surfaces of the mold plates, and an outer thermal barrier configured to control solidification of molten metal in the mold cavities by retarding heat transfer in mold plate material between the mold cavities and an outer periphery of the mold plate stack.

The apparatus can further comprise an inner thermal barrier which retards heat transfer in the mold plate material between the mold cavities and the down-sprue. The outer thermal barrier can be a channel extending into a surface of each mold plate and the inner thermal barrier can be a channel extending into a surface of each mold plate. In an embodiment, the outer and inner thermal barriers are air gaps. The mold plates can be made of sand and the air gaps can be annular channels having a width of up to about 0.05 to about 0.3 inch.

In an embodiment, each of the mold plates is a circular sand mold plate having a central opening corresponding to the down-sprue extending vertically between upper and lower surfaces of the mold plate, at least two circumferentially spaced openings corresponding to the up-sprues extending vertically between the upper and lower surfaces of the mold plate, at least two ring-shaped mold cavities extending into the upper surface of the mold plate, at least two circular recesses extending into the upper surface of the mold plate at locations such that each ring-shaped mold cavity surrounds one of the circular recesses, at least two runners arranged such that at least one of the runners extends from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

In another embodiment, each of the mold plates is a circular sand mold plate having a central opening corresponding to the down-sprue extending vertically between upper and lower surfaces of the mold plate, at least three circumferentially spaced openings corresponding to the up-sprues extending vertically between the upper and lower surfaces of the mold plate, at least nine ring-shaped mold cavities extending into the upper surface of the mold plate, at least nine circular recesses extending into the upper surface of the mold plate at locations such that each ring-shaped mold cavity surrounds one of the circular recesses, at least nine runners arranged such that at least three of the runners extend from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

In a further embodiment, each of the mold plates is a circular sand mold plate having a central opening corresponding to the down-sprue extending vertically between upper and lower surfaces of the mold plate, at least six circumferentially spaced openings corresponding to the up-sprues extending vertically between the upper and lower surfaces of the mold plate, at least eighteen ring-shaped mold cavities extending into the upper surface of the mold plate, at least eighteen circular recesses extending into the upper surface of the mold plate at locations such that each ring-shaped mold cavity surrounds one of the circular recesses, at least eighteen runners arranged such that at least three of the runners extend from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

The down-sprue can be located at a center of the mold plate stack and the up-sprues are circumferentially spaced apart and located equidistant from the down-sprue. The mold cavities can be ring-shaped channels having a depth extending vertically into an upper surface of each mold plate, and the outer and inner thermal barriers can each comprise an annular channel having a depth in the vertical direction at least equal to the depth of the mold cavities.

BRIEF DESCRIPTION OF THE DRAWINGS

(FIG. 8A) and J3, a cobalt-based alloy available from L.E. Jones Co. (FIG. 8B) wherein temperatures are shown for a thermal jacket mold plate arrangement (curve A) and a conventional mold plate arrangement (curve B).

DETAILED DESCRIPTION

Disclosed herein is an improved casting system useful for mass production of valve seat inserts made of high alloy compositions.

Unless otherwise indicated, all numbers expressing quantities, conditions, and the like in the instant disclosure and claims are to be understood as modified in all instances by the term "about." The term "about" refers, for example, to numerical values covering a range of plus or minus 10% of the numerical value. The modifier "about" used in combination with a quantity is inclusive of the stated value.

In this specification and the claims that follow, singular forms such as "a", "an", and "the" include plural forms unless the content clearly dictates otherwise.

The terms "room temperature", "ambient temperature", and "ambient" refer, for example, to a temperature of from about 20° C. to about 25° C.

Figure 1:
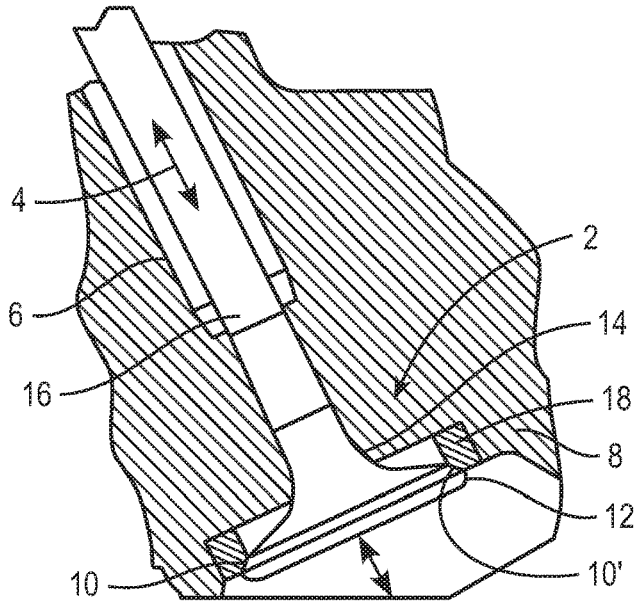
FIG. 1 is a cross-sectional view of a valve-assembly incorporating a valve seat insert of an iron-based alloy according to an embodiment of the instant application.

FIG. 1 illustrates an exemplary valve assembly 2 according to the present disclosure. Valve assembly 2 may include a valve 4, which may be slidably supported within the internal bore of a valve stem guide 6 and a valve seat insert 18. The valve stem guide 6 may be a tubular structure that fits into the cylinder head 8. Arrows illustrate the direction of motion of the valve 4. Valve 4 may include a valve seat face 10 interposed between the cap 12 and neck 14 of the valve 4. Valve stem 16 may be positioned above the neck 14 and may be received within valve stem guide 6. The valve seat insert 18 may include a valve seat insert face 10' and may be mounted, such as by press-fitting, within the cylinder head 8 of the engine. In embodiments, the cylinder head 8 may comprise a casting of, for example, cast iron, aluminum, or an aluminum alloy. In embodiments, the insert 18 (shown in cross-section) may be annular in shape, and the valve seat insert face 10' may engage the valve seat face 10 during movement of valve 4.

The valve seat insert 18 can be made from various alloy compositions which have been cast and machined. Large scale production of valve seat inserts is typically done by using stacked mold plates with multiple castings in each mold plate. With modern valve seat inserts, high alloy compositions are used to meet the high temperature, high stress, and harsh combustion environment conditions. Valve seat insert castings made of high performance alloys for heavy-duty engine applications preferably have uniform and desired solidification substructures. However, solute distribution in a high alloy often involves solute element redistribution which affects the final solidification substructural formation and morphology. For example, with intermetallic strengthened cobalt-based alloys, it can be very difficult to achieve uniformly distributed solidification substructure such as between soft cobalt solid solution phases and intermetallic Laves phases. In some high alloys, eutectic reaction phases can form after formation of primary dendritic structures with the result being eutectic phases interdendritically distributed. Fine and uniform distribution of solidification structures including eutectic reaction phases is preferred from a product performance and component shaping related process (e.g., machining) consideration.

In order to improve yield of cast valve seat inserts, it is desirable to improve machining characteristics of the cast parts. For parts made by casting in conventional molds, an off-set adjustment of cutting tools needs to be performed after machining 30 cast parts. In contrast, using an improved thermal jacket mold design, it is possible to produce cast parts wherein the off-set adjustment is not needed until after machining 150 cast parts. While not wishing to be bound by theory, it is believed that the improved microstructure of the cast parts made using the thermal jacket mold design provides an improved microhardness distribution pattern.

Figure 2:
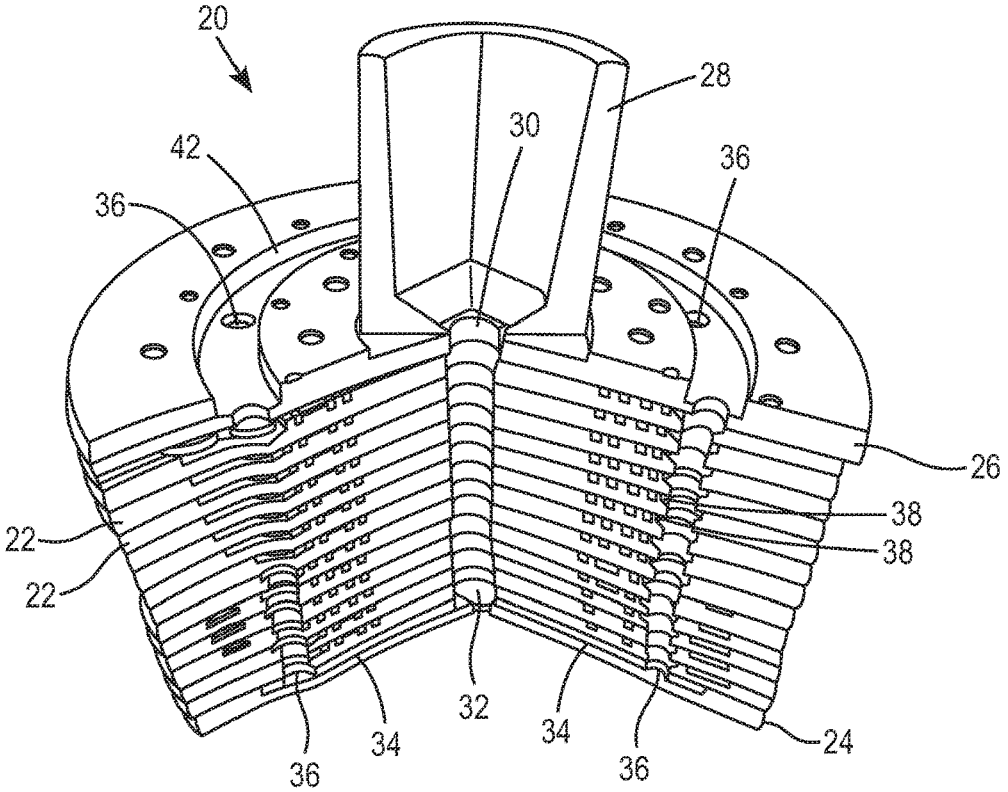
FIG. 2 shows a casting system useful for casting valve seat inserts.

FIG. 2 shows a sand casting system 20 for mass production of vale seat insert castings wherein circular mold plates 22 made of sand are stacked vertically between a bottom mold 24 and a top mold 26. A casting header 28 is located at the center of the top mold 26 with an outlet-30 aligned vertically with a central down-sprue 32 extending through the top mold 26. The down-sprue 32 extends downwardly through each mold plate 22 and communicates with horizontal distribution sprues 34 below the lowest mold plate. The horizontal sprues 34 communicate with up-sprues 36 extending upwardly through the mold plates 22. The up-sprues 36 communicate with runners 38 which communicate with one or more mold cavities 40 in each mold plate 22. Tops of the up-sprues 36 communicate with an annular recess 42 in the upper surface of the top mold. When molten metal is poured into the casting header 28, the liquid metal flows through the down-sprue 32, the horizontal sprues 34, the up-sprues 36, the runners 38 into the mold cavities 40 and poring of molten metal is stopped when the liquid metal reaches the annular recess 42.

Figure 3:
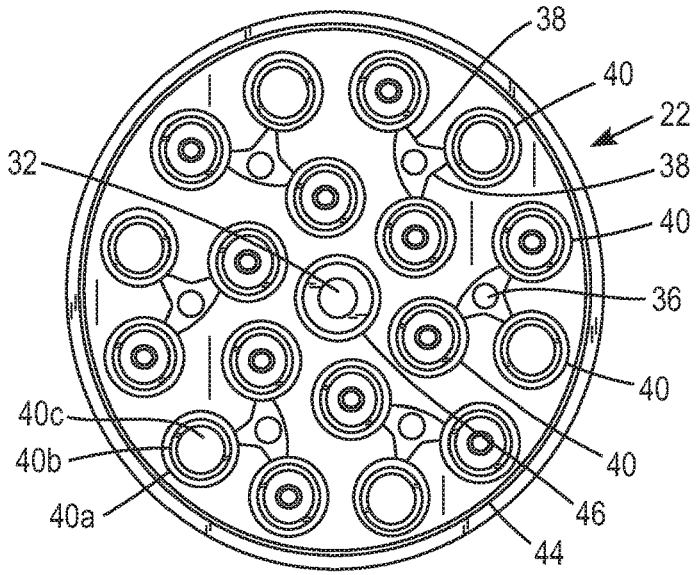
FIG. 3 shows a mold plate which can be used in the casting system shown in FIG. 2.

The system 20 can include various arrangements of sprues, runners/gates and mold cavities. Depending on the size of the valve inserts, one or more up-sprues may feed one, two, three, four or more mold cavities in each mold plate. In an example, a mold plate 22 may have six up-sprues 36 and three mold cavities 40 in communication with each up-sprue 36 via runners 38, as shown in FIG. 3. The mold cavities 40 are ring-shaped cavities formed by a space between an outer cylindrical wall 40*a* and an inner cylindrical wall 40*b* which surrounds a cylindrical recess 40*c*. A thin sand wall can separate the mold cavity 40 from the cylindrical recess 40*c* such that during solidification of the molten metal in the mold cavity 40, the thin wall of sand can be forced inward as the molten metal becomes solid and shrinks.

The valve seat inserts are made by pouring molten metal into a gating system of a mold plate stack wherein mold plates are located between top and bottom molds. If the stack of mold plates includes mold plates having 18 mold cavities in each mold plate as shown in FIG. 3, if the stack includes 10 mold plates, 180 valve seat inserts can be cast in a single pouring. The mold plates are preferably made of conventional green shell sand for VSI casting applications and are designed such that during solidification of the molten metal in the mold cavities, the binder in the sand is volatilized and thin sand walls forming the inner surfaces of the valve seat inserts collapse as the valve seat inserts contract due to shrinkage upon solidification of the molten metal.

In order to provide a more uniform temperature distribution during solidification of molten metal in the mold cavities 40, the mold plate 22 includes an outer thermal barrier 44 and an inner thermal barrier 46, as shown in FIG. 3. The outer thermal barrier 44 can be an annular channel extending into an upper surface of the mold plate 22. Likewise, the inner thermal barrier 46 can be an annular channel extending into the upper surface of the mold plate 22. The annular channels forming the outer and inner thermal barriers 44, 46 are preferably air gaps which minimize heat transfer in directions towards the down-sprue 32 and exterior of the mold plate 22. The annular channels preferably have a depth about equal to the vertical height of the mold cavity and a width of about 0.005 to 0.3 inch. For instance, the annular channels can have a width of about 1/16 to 1/4 inch.

Figure 4:
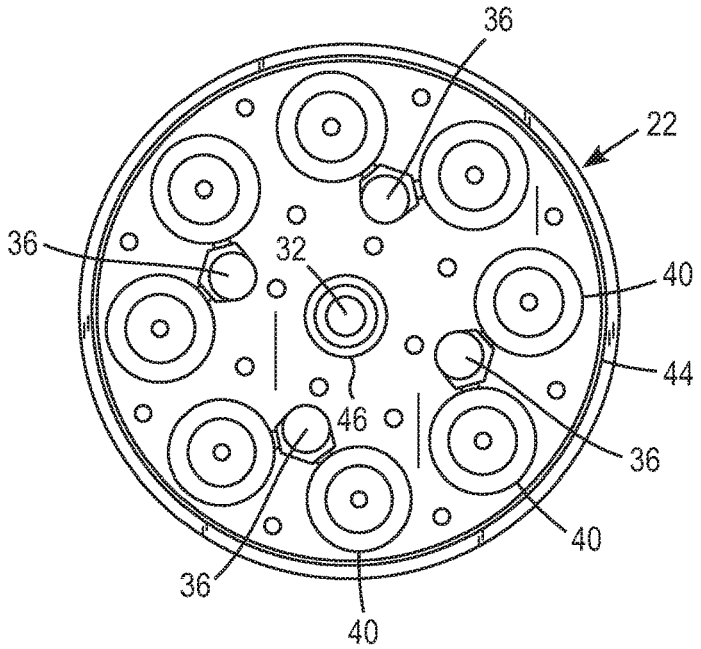
FIG. 4 shows a mold plate which can be used in the casting system shown in FIG. 2.

In another example, each of the mold plates 22 can include four up-sprues 36 with each up-sprue connected 36 to two runners 38, each runner 38 communicating with a single mold cavity 40, as shown in FIG. 4. Thus, in a stack of 10 mold plates 22, 80 valve seat inserts could be cast with the arrangement shown in FIG. 4.

Figure 5:
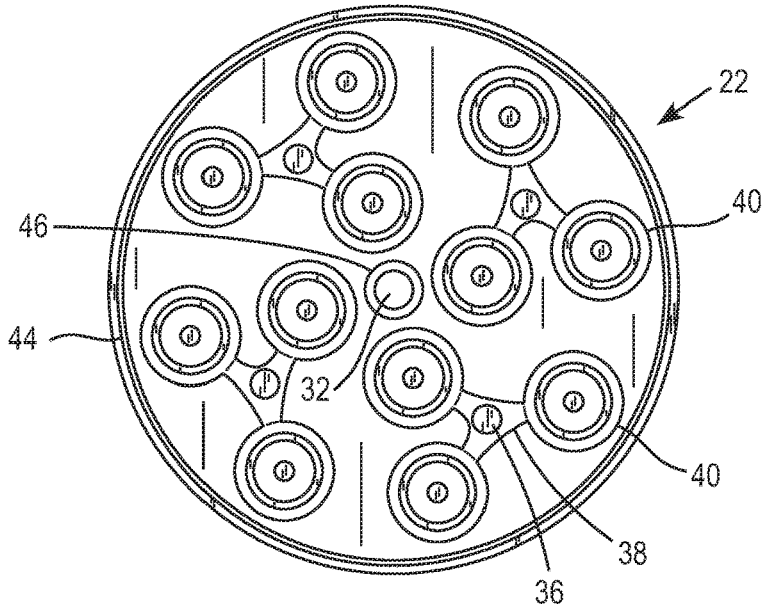
FIG. 5 shows a mold plate which can be used in the casting system shown in FIG. 2.
Figure 6:
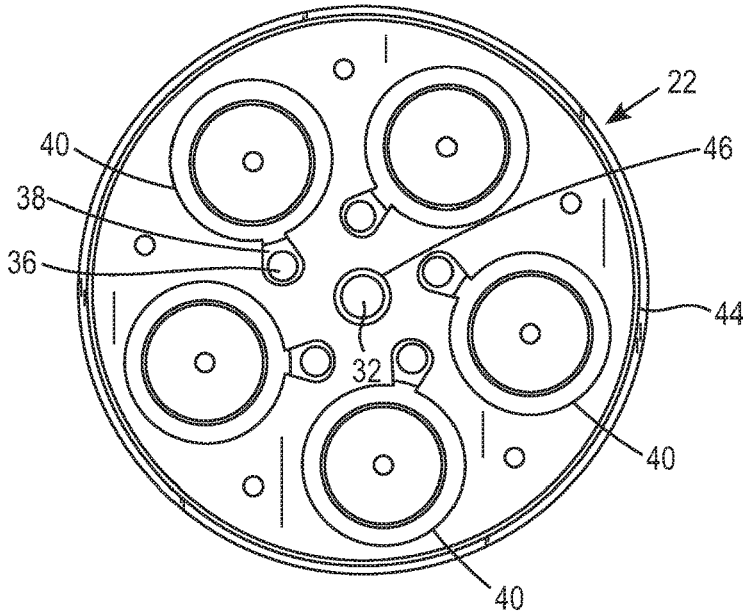
FIG. 6 shows a mold plate which can be used in the casting system shown in FIG. 2.

FIG. 5 shows an arrangement wherein the mold plate 22 includes four up-sprues 36 with each up-sprue 36 connected to three mold cavities 40 via runners 38. For large diameter valve seat inserts, FIG. 6 shows a mold plate 22 having four up-sprues 36 with each up-sprue 36 connected to a single mold cavity 40.

Figure 7A:
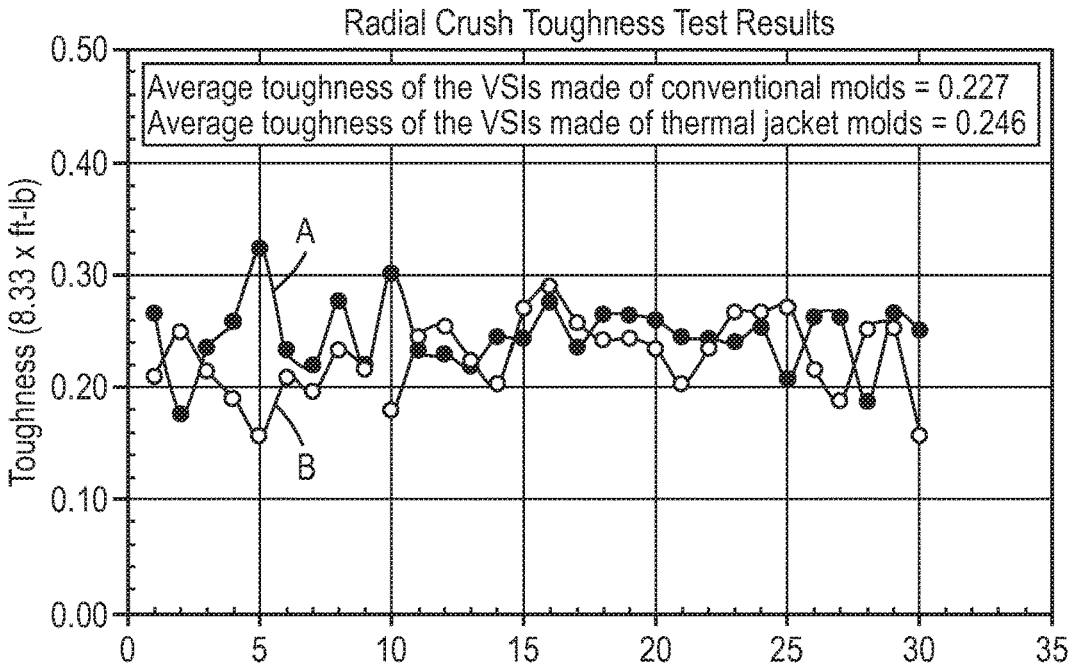
FIG. 7A is a graph of radial crush strength for samples made using a thermal jacket mold plate arrangement (curve A) and samples made using conventional mold plates (curve B) and FIG. 7B is a graph of bulk hardness for samples made using a thermal jacket mold plate arrangement (curve A) and samples made using conventional mold plates (curve B).
Figure 7B:
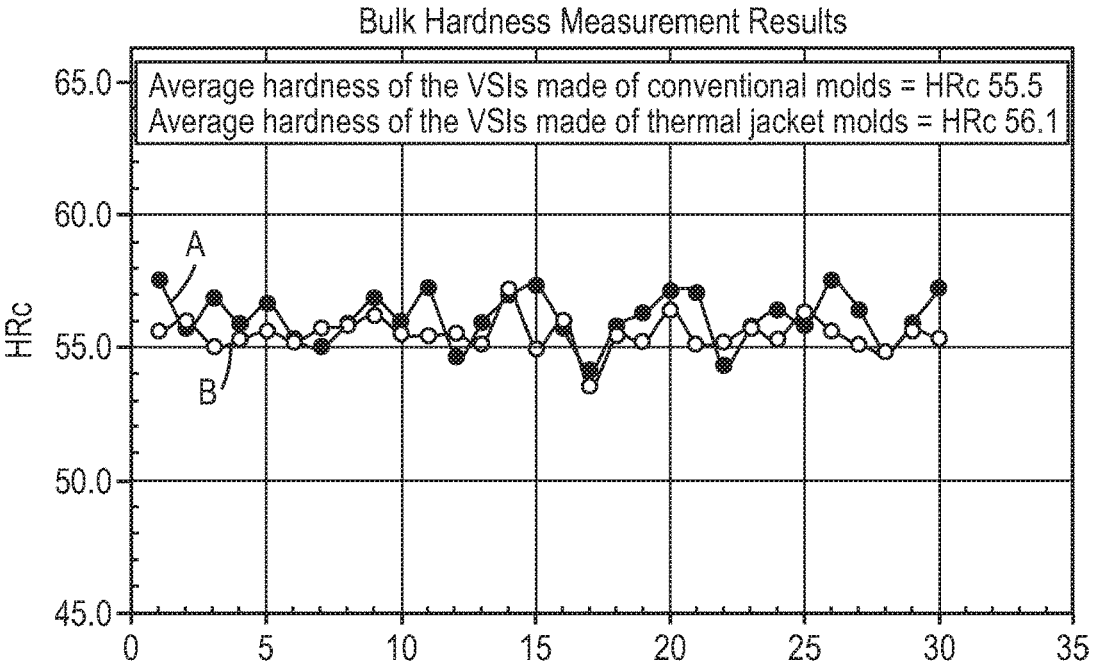

In order to improve yield of cast valve seat inserts and/or lower costs of machining of the cast valve seat inserts, it is desirable to control the microstructure of the cast parts such that the microhardness distribution is more uniform. By improving uniformity of the microstructure, machinability of the cast valve seat inserts can be improved. FIG. 7 shows radial crush testing results for LE Jones proprietary alloy J10, a cobalt-based alloy. The radial crush test is a measure of toughness conducted at room temperature. Valve seat inserts made of the J10 alloy using conventional mold plates exhibits poor machinability whereas valve seat inserts made with thermal jacket molds exhibited unexpectedly improved machinability even though the cast parts exhibited the same overall toughness and bulk hardness, as shown in FIGS. 7A and 7B. FIG. 7A is a graph of radial crush strength for samples made using a thermal jacket mold plate arrangement (curve A) and samples made using conventional mold plates (curve B) and FIG. 7B is a graph of bulk hardness for samples made using a thermal jacket mold plate arrangement (curve A) and samples made using conventional mold plates (curve B).

In a preferred casting system for mass production of valve seat inserts, mold plates made of sand and having a diameter of about 14 inches can have a central 1 inch diameter down-sprue, horizontal bottom sprues feeding an equal number of up-sprues having diameters of about ½ to ¾ inch, rectangular runners which taper in cross section, and mold cavity gates having heights of about ⅔ the valve seat insert height and widths of about 1.6 times the gate height.

Figure 8A:
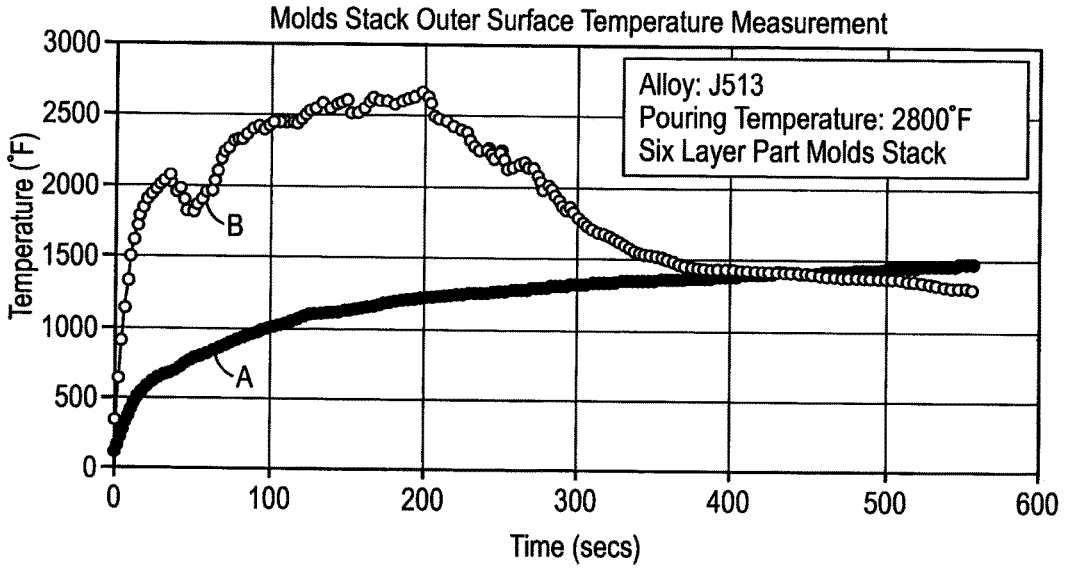
FIGS. 8A and 8B are graphs of mold stack outer surface temperature versus time for J513, an iron-base alloy available from L.E. Jones Co.
Figure 8B:
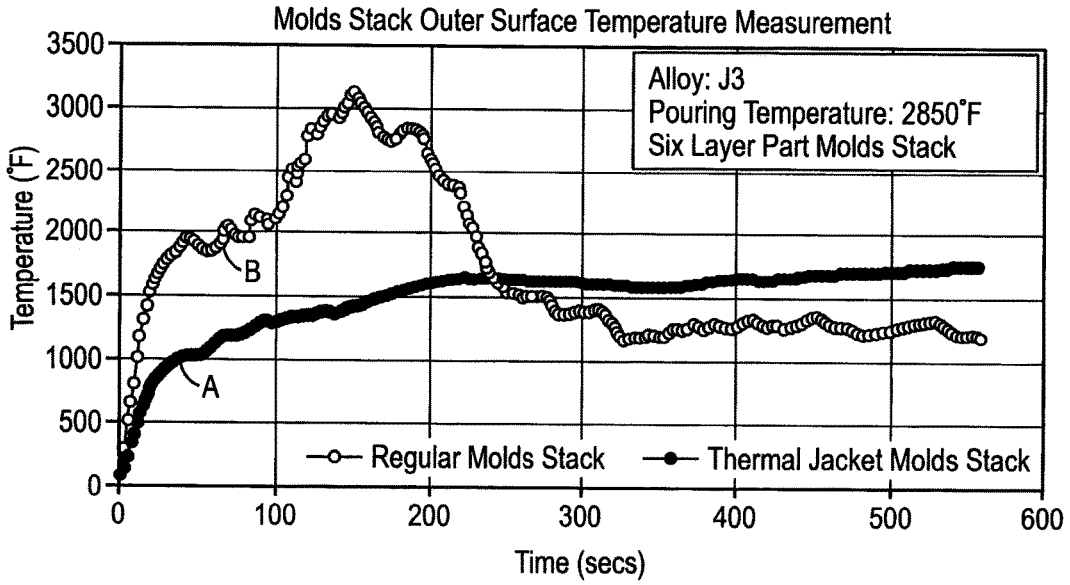

FIGS. 8A and 8B are graphs of mold stack outer temperatures versus time for two different alloys cast at two different temperatures. To obtain the thermal measurements, a thermocouple (Type K) was placed at the mold stack surface between the first and second part molds from the bottom mold and the temperature was recorded as soon as pouring was initiated. The same pouring temperature was used for each alloy so that the energy input in the mold stack was the same for conventional (regular) mold stack and thermal jacket mold stack. FIG. 8A shows the temperature versus time graphs for J513 (an iron-based alloy available from L.E. Jones) cast at 2800° F. wherein curve A shows the results for a thermal jacket mold stack and curve B shows the results for a conventional mold stack. FIG. 8B shows the temperature versus time graphs for J3 (a cobalt-based alloy available from L.E. Jones) cast at 2850° F. wherein curve A shows the results for a thermal jacket mold stack and curve B shows the results for a conventional mold stack. As can be seen from these graphs, the thermal jacket mold stack retards heat transfer to the outer surface of the mold stack and thus provides slower cooling of the cast parts and thus provide a more uniform microstructure in the cats parts.

It will be appreciated by those skilled in the art that the casting method and apparatus described herein can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method of casting valve seat inserts, comprising:

pouring molten metal into a gating system of a mold plate stack wherein mold plates are located between top and bottom molds, the gating system including a casting header, down-sprue, horizontal sprue, up-sprues, runners, and gates in fluid communication with mold cavities configured to form the valve seat inserts;

filling the mold cavities with the molten metal;

controlling solidification of the molten metal in the mold cavities by means of an outer thermal barrier which retards heat transfer in mold plate material between the mold cavities and an outer periphery of the mold plate stack, wherein solidification of the molten metal in the mold cavities is further controlled by means of an inner thermal barrier which retards heat transfer in the mold plate material between the mold cavities and the down-sprue, wherein the outer thermal barrier is a channel extending into a surface of each mold plate, and wherein the inner thermal barrier is a channel extending into a surface of each mold plate.

2. The method of claim 1, wherein the outer and inner thermal barriers are air gaps.

3. The method of claim 1, wherein each of the mold plates is a circular sand mold plate having a central opening corresponding to the down-sprue extending vertically between upper and lower surfaces of the mold plate, at least two circumferentially spaced openings corresponding to the up-sprues extending vertically between the upper and lower surfaces of the mold plate, at least two ring-shaped mold cavities extending into the upper surface of the mold plate, at least two circular recesses extending into the upper surface of the mold plate at locations such that each ring-shaped mold cavity surrounds one of the circular recesses, at least two runners arranged such that at least one of the runners extends from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

4. The method of claim 3, wherein each of the mold plates is a circular sand mold plate having a central opening corresponding to the down-sprue extending vertically between upper and lower surfaces of the mold plate, at least four circumferentially spaced openings corresponding to the up-sprues extending vertically between the upper and lower surfaces of the mold plate, at least eight ring-shaped mold cavities extending into the upper surface of the mold plate, at least eight circular recesses extending into the upper surface of the mold plate at locations such that each ring-shaped mold cavity surrounds one of the circular recesses, at least eight runners arranged such that at least two of the runners extend from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

5. The method of claim 3, wherein each of the mold plates is a circular sand mold plate having a central opening corresponding to the down-sprue extending vertically between upper and lower surfaces of the mold plate, at least six circumferentially spaced openings corresponding to the up-sprues extending vertically between the upper and lower surfaces of the mold plate, at least eighteen ring-shaped mold cavities extending into the upper surface of the mold plate, at least eighteen circular recesses extending into the upper surface of the mold plate at locations such that each ring-shaped mold cavity surrounds one of the circular recesses, at least eighteen runners arranged such that at least three of the runners extend from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

6. The method of claim 1, wherein the molten metal is a wear and corrosion resistant alloy, nickel-base alloy, or cobalt-base alloy, the method further comprising maintaining a uniform temperature distribution of the molten metal during solidification of the valve seat inserts.

7. The method of claim 1, wherein the top mold incudes an annular recess in an upper surface thereof, the annular recess in fluid communication with the up-sprues, the method including filling the mold cavities with molten metal until the annular recess contains overflow of the molten metal and provides a visual indication of when the molten metal has filled all of the mold cavities.

8. An apparatus for casting valve seat inserts, comprising:

a mold plate stack comprising mold plates located between top and bottom molds, and a gating system including a casting header, down-sprue, horizontal sprue, up-sprues, runners, and gates in fluid communication with mold cavities configured to form the valve seat inserts;

the mold cavities located in upper surfaces of the mold plates;

an outer thermal barrier configured to control solidification of molten metal in the mold cavities by retarding heat transfer in mold plate material between the mold cavities and an outer periphery of the mold plate stack; and an inner thermal barrier which retards heat transfer in the mold plate material between the mold cavities and the down-sprue;

wherein the outer thermal barrier is a channel extending into a surface of each mold plate and the inner thermal barrier is a channel extending into a surface of each mold plate.

9. The apparatus of claim 8, wherein the outer and inner thermal barriers are air gaps.

10. The apparatus of claim 9, wherein the mold plates are made of sand and the air gaps are annular channels having a width of up to about 0.05 to about 0.3 inch.

11. The apparatus of claim 8, wherein each of the mold plates is a circular sand mold plate having a central opening corresponding to the down-sprue extending vertically between upper and lower surfaces of the mold plate, at least two circumferentially spaced openings corresponding to the up-sprues extending vertically between the upper and lower surfaces of the mold plate, at least two ring-shaped mold cavities extending into the upper surface of the mold plate, at least two circular recesses extending into the upper surface of the mold plate at locations such that each ring-shaped mold cavity surrounds one of the circular recesses, at least two runners arranged such that at least one of the runners extends from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

12. The apparatus of claim 11, wherein each of the mold plates is a circular sand mold plate having a central opening corresponding to the down-sprue extending vertically between upper and lower surfaces of the mold plate, at least three circumferentially spaced openings corresponding to the up-sprues extending vertically between the upper and lower surfaces of the mold plate, at least nine ring-shaped mold cavities extending into the upper surface of the mold plate, at least nine circular recesses extending into the upper surface of the mold plate at locations such that each ring-shaped mold cavity surrounds one of the circular recesses, at least nine runners arranged such that at least three of the runners extend from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

13. The apparatus of claim 11, wherein each of the mold plates is a circular sand mold plate having a central opening corresponding to the down-sprue extending vertically between upper and lower surfaces of the mold plate, at least six circumferentially spaced openings corresponding to the up-sprues extending vertically between the upper and lower surfaces of the mold plate, at least eighteen ring-shaped mold cavities extending into the upper surface of the mold plate, at least eighteen circular recesses extending into the upper surface of the mold plate at locations such that each ring-shaped mold cavity surrounds one of the circular recesses, at least eighteen runners arranged such that at least three of the runners extend from each of the circumferentially spaced openings and each of the runners/gates is in fluid communication with one of the ring-shaped mold cavities, the outer thermal barrier comprises an annular channel extending into the upper surface to a predetermined depth suitable to provide uniform solidification of the molten metal in the mold cavities, and the inner thermal barrier comprises an annular channel extending into the upper surface to the predetermined depth.

14. The apparatus of claim 8, wherein the down-sprue is located at a center of the mold plate stack and the up-sprues are circumferentially spaced apart and located equidistant from the down-sprue.

15. The apparatus of claim 8, wherein the mold cavities are ring-shaped channels having a depth extending vertically into an upper surface of each mold plate, the outer and inner thermal barriers each comprising an annular channel having a depth in the vertical direction at least equal to the depth of the mold cavities.

* * * * *